US005582331A

United States Patent [19]

Van Moerkerken

[11] Patent Number: 5,582,331

[45] Date of Patent: Dec. 10, 1996

[54] CAULKING GUN AND CARTRIDGE WITH AFTERFLOW PREVENTION

[76] Inventor: Arthur Van Moerkerken, 18761 W. Dixie Hwy., North Miami Beach, Fla. 33180

[21] Appl. No.: 527,755

[22] Filed: Sep. 13, 1995

[51] Int. Cl.[6] ..... B65D 88/54

[52] U.S. Cl. ..... 222/327; 222/386

[58] Field of Search ..... 222/327, 386, 222/389, 391

[56] References Cited

U.S. PATENT DOCUMENTS

| | | | |
|---|---|---|---|
| 4,509,662 | 4/1985 | Weiss . | |
| 4,793,521 | 12/1988 | Steiner . | |
| 4,834,268 | 5/1989 | Keller . | |
| 4,854,485 | 8/1989 | Collins | 222/327 X |
| 4,869,403 | 9/1989 | Brüning . | |
| 4,982,878 | 1/1991 | Schmidt . | |
| 5,016,784 | 5/1991 | Batson . | |
| 5,236,105 | 8/1993 | Galex . | |
| 5,419,466 | 5/1995 | Scheindel | 222/389 |

*Primary Examiner*—Gregory L. Huson

*Attorney, Agent, or Firm*—Herbert L. Lerner; Laurence A. Greenberg

[57] ABSTRACT

A caulking gun and cartridge combination is provided with afterflow prevention. The cartridge has a tubular body, a forward dispensing opening at a forward end of the tubular body, and a backwall movably disposed within the tubular body. The caulking gun has a trough for receiving the cartridge, and a piston movable parallel to the trough. A trigger handle is used for pushing the backwall forward within the tubular body and causing a reduction of volume within the chamber in the cartridge. The backwall slides substantially in a contact-less manner within the tubular body, preferably by way of a reduced diameter of the backwall relative the inner diameter of the tubular body, so that it is pushed backwardly when the body retracts radially after actuation. Alternatively, the cartridge body may be prevented from expanding or may even be actively squeezed so that afterflow caused by the volume reduction of the relaxing tube body is safely prevented.

6 Claims, 4 Drawing Sheets

CAULKING GUN AND CARTRIDGE WITH AFTERFLOW PREVENTION

BACKGROUND OF THE INVENTION

1. Field of the Invention

The invention relates to caulking guns and to dispensing cartridges, and more particularly to the type of composition dispensers in which a cartridge is placed into a gun structure and a piston urges a plunger forwardly from the rear of the cartridge, thus reducing a volume available for the composition inside the cartridge and forcing the composition from an open tip at the front of the cartridge.

These types of caulking guns have been the subject of undesireable afterflow, i.e. the interior of the cartridge is still subject to overpressure after the plunger is no longer actively urged forward and, as a result, additional amounts of composition are forced from the cartridge.

Two primary reasons for the afterflow phenomenon are recognized. Firstly, the usually thin-walled cartridge expands during the plunger actuation and, according to the physical law that systems always attempt to return to the relaxed state, the cartridge wall relaxes after the plunger actuation. Due to the fact that prior art backwalls of the cartridges have been devised to retain their forward-most position and that the plunger of the caulking gun is typically locked against a return movement, the relaxation of the cartridge wall leads to afterflow, i.e. to oozing at the dispensing tip. Secondly, most caulking compositions have a high degree of viscosity and are at least marginally compressible, which, upon plunger actuation, causes a substantial internal pressure buildup which, after the plunger is no longer forced forward, also leads to oozing at the dispensing tip.

2. Description of the Related Art

The afore-described afterflow problem is often answered in the context of conventional prior art structures by quickly releasing and moving back the gun plunger as soon a sufficient amount of composition has been dispensed.

U.S. Pat. No. 5,236,105 to Galex describes a novel system for preventing over-ejection. In that system, conventional caulking guns are retrofitted with several members, namely a female element, male element, a return spring, and a stop. The spring is utilized as an active biassing element which actively pulls back the backwall in the cartridge and thus introduces a relative vacuum inside the cartridge.

U.S. Pat. No. 4,834,268 to Keller describes a plunger system in which an elastic sealing ring is urged towards the inner wall surface of the cartridge by a radial component of the force which urged to plunger forwardly in the dispensing mode. When the plunger is no longer actuated, the sealing ring relaxes slightly and allows the plunger to relax the inside cartridge pressure.

The first of the above-noted methods of preventing afterflow is clearly unsatisfactory. The systems described in the two afore-mentioned patents are quite complicated and thus rather expensive.

SUMMARY OF THE INVENTION

It is accordingly an object of the invention to provide a caulking gun and cartridge with afterflow prevention, which overcomes the above-mentioned disadvantages of the prior art devices and methods of this general type. The primary object is to provide a simple and inexpensive system which is applicable to a wide array of catridges and caulking guns and which safely prevents overflow or over-ejection.

With the foregoing and other objects in view there is provided, in accordance with the invention, an improved caulking cartridge, of the type having a substantially tubular body, a forward dispensing opening at a forward end of the tubular body, a backwall movably disposed within the tubular body, the tubular body having a wall with an inner wall surface defining an inner diameter of the tubular body, and the tubular body defining a chamber therein bounded by the inner wall surface, the forward end and the backwall. The improvement is defined in that the backwall has a diameter which is less than the inner diameter of the tubular body and there is defined a substantially contact-free spacing distance between the inner wall surface and a periphery of the backwall.

In accordance with an added feature of the invention, the distance is at least 0.2 mm, and it may be up to more than 1.0 mm.

In accordance with another feature of the invention, there are provided spacer ridges formed on a circumference of the backwall, the spacer ridges being in contact with the inner wall surface of the tubular body and defining the spacing distance.

With the above and other objects in view there is also provided, in accordance with the invention, a combination caulking gun and cartridge. The cartridge has a substantially tubular body, a forward dispensing nozzle at a forward end of the tubular body, a backwall movably disposed within the tubular body, the tubular body defining a chamber therein between the forward end and the backwall. The caulking gun thereby comprises a body forming a trough for receiving the cartridge, and a piston movable parallel to the trough for pushing the backwall forward within the tubular body and causing a reduction of volume within the chamber in the cartridge. The tubular body has a wall with an inner wall surface defining an inner diameter of the tubular body, and the backwall having a diameter less than the inner diameter of the tubular body and defining a substantially contact-free spacing distance between the inner wall surface and the backwall.

In accordance with a further feature of the invention, there are provided means operatively associated with the tubular body of the cartridge for preventing a radial expansion of the tubular body while the piston forces the backwall forward. These prevention means may be in the form of a rigid tubular sleeve tightly fit on the tubular body, for instance by slipping the cartridge into the sleeve.

In accordance with again another feature of the invention, the tubular sleeve is formed of a hard material selected from the group consisting of PVC, fiber-reinforced plastic, and metal.

In accordance with again a further feature of the invention, the prevention means is a clamp device disposed at the trough of the caulking gun for selectively squeezing the tubular body of the cartridge.

In accordance with a concomitant feature of the invention, the caulking gun has a trigger handle pushing the piston forward for dispensing caulking composition, and the clamp device is connected to the trigger handle of the caulking gun such that the tubular body is squeezed simultaneously with the piston forcing the backwall forward.

Other features which are considered as characteristic for the invention are set forth in the appended claims.

Although the invention is illustrated and described herein as embodied in a caulking gun and cartridge with afterflow prevention, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
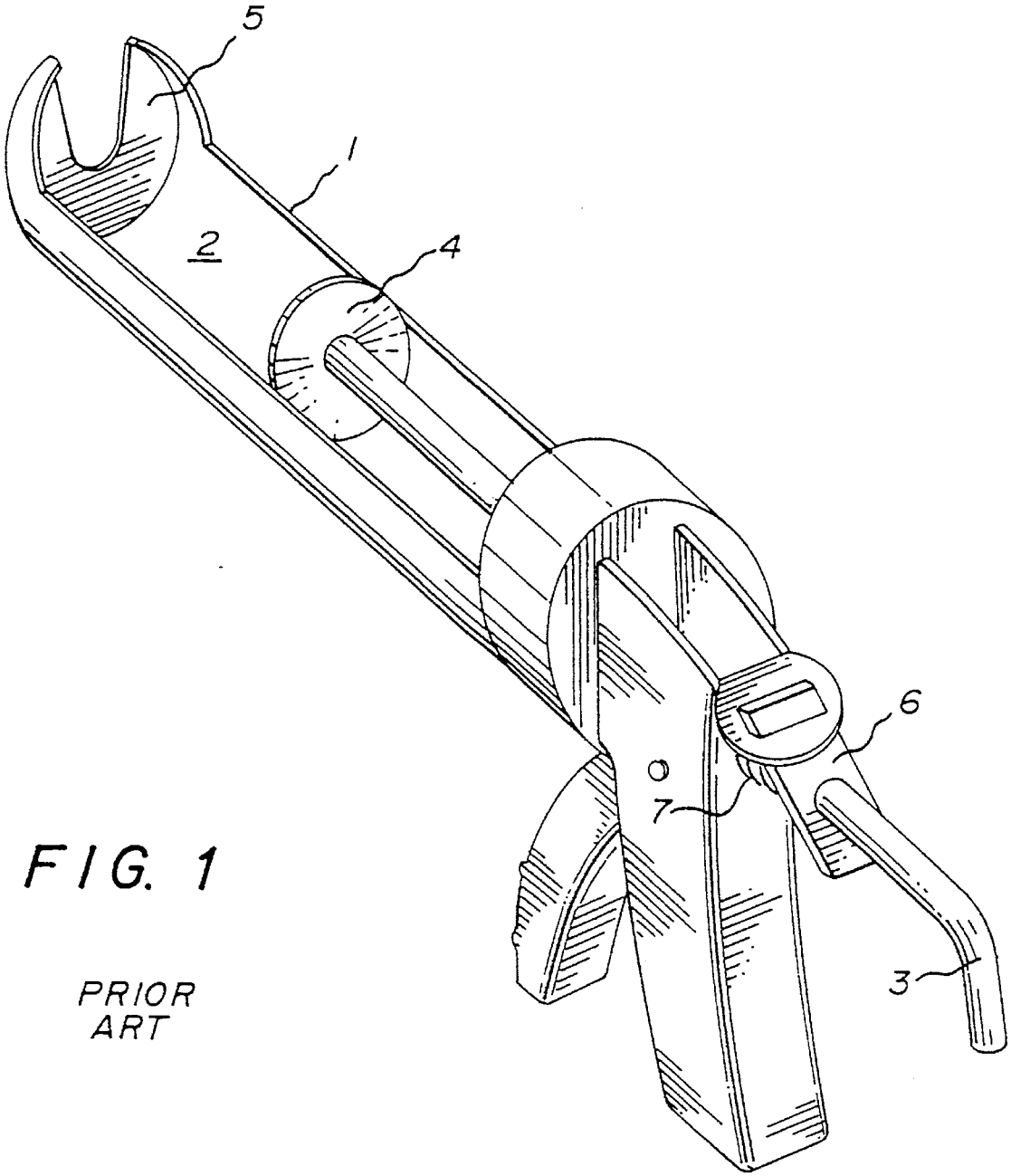
FIG. 1 PRIOR ART
FIG. 1 is a perspective view of a prior art caulking gun.

Referring now to the figures of the drawing in detail and first, particularly, to FIG. 1 thereof, there is seen a conventional caulking gun. A forward body 1 is formed with a trough 2, which receives a caulking cartridge. A piston stem 3 pushes a plunger head 4 forward towards a forward end wall 5 of the trough 2. A locking dog 6 prevents the stem 3 from moving backwards, and a spring 7 biasses the dog 6 into the locking position. The stem 3 is released and allowed to move backwardly by swinging the dog 6 forward into a substantially vertical release position.

Figure 2:
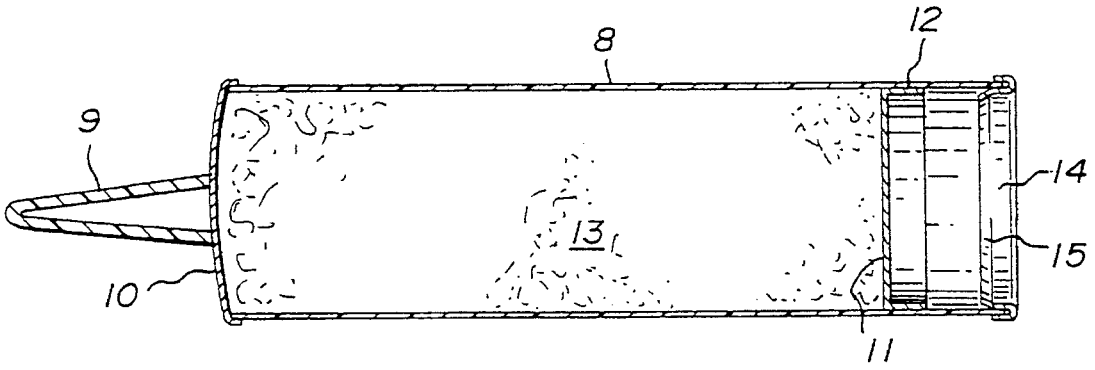
FIG. 2 PRIOR ART
FIG. 2 is a longitudinal section of a prior art caulking cartridge.

With reference to FIG. 2, a typical prior art caulking tube has tubular body 8. Usually, the body is formed as a cylindrical tube 8, which is formed of paper laminate, fibrous plastics, rolled metal sheets, or the like. The cylindrical tube 8 is relatively soft and, in response to increased pressure in the interior chamber thereof, it expands radially. A nozzle tip 9 is formed on a forward closure wall 10. The tube 8 is air-tightly closed in the rear with a backplate 11. An outer cylindrical flange 12 of the backplate 11 has an outer radius which corresponds to an inner radius of the tube 8. The flange 12 forms a sliding seal between the inner wall surface of the tube 8 and the backwall 11. A reinforcing ring 14 with a cylindrical seal flange 15 is clamped at the rear edge of the tube 8. In storage, the backwall 11 is disposed directly adjacent the ring 14, such that the flange 12 is clamped under the seal flange 15. Only after the forward wall 10 is punctured and the nozzle tip 9 is cut to form a dispenser opening is the backwall 11 pushed forward for dispensing caulking composition 13.

As the backwall 11 is pushed forward and the flange 12 slides as along the inner wall surface of the tube 8, the caulking composition 13 is forced from the dispensing tip because of the increased pressure inside the tube chamber. Besides pushing composition 13 out of the dispensing tip, the increased pressure also causes the tube body to expand radially. In fact, it can be shown that the radial pressure on the cylindrical tube wall is exactly twice the axially acting pressure towards the dispensing opening. This radial "breathing" of the tube 8 causes afterflow when the piston 4 is no longer actuated and the tube 8 resiliently relaxes its increased diameter towards the relaxed position.

Figure 3:
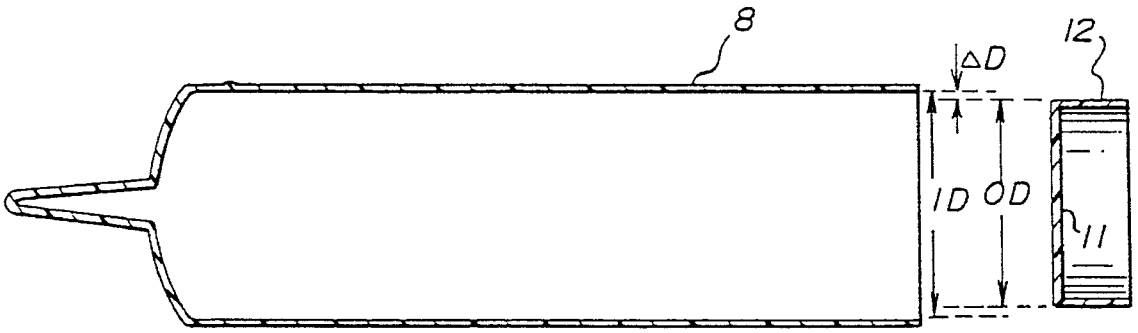
FIG. 3 is a similar section of a caulking cartridge according to a first embodiment of the invention.

Referring now to FIG. 3, which illustrates a first embodiment of the invention, an outer diameter OD of the cylindrical flange 12 is smaller than an inner diameter ID of the tube 8 by a spacing $\Delta D$. The spacing $\Delta D$ is chosen in dependence on the caulking composition 13, i.e. on the viscosity and its reaction rate with air. In other words, the higher the viscosity of the composition, the greater the spacing $\Delta D$. Further, the more inert the composition is relative to the atmosphere, the greater the spacing $\Delta D$. In general, tubes for typical silicones, glycerol esters, resin and rosin acids, and the like may be provided with a spacing of $\Delta D=1$ mm. Tubes for compositions with a lower viscosity may be provided with $\Delta D \leqq 0.2$ mm. Proper spacings may be chosen by those of skill in the art.

The flange 12 and the inner wall surface of the tube 8 form a contact-less seal by virtue of a small amount of caulking composition which is allowed to seep therebetween. Due to the fact that the dispensing opening is substantially larger in area than the area defined (approximately) by the spacing $\Delta D$ times the circumference, only a negligible amount of caulking composition is allowed to escape through that route. As soon as the pressure on the piston is relaxed and the piston is moved back, the backwall 11 follows suit as the tube wall attains its relaxed position. As the caulking composition within the spacing between the flange 12 and the tube is still fresh (its viscosity is at its minimum), the backwall 11 slides easily. Shortly after the backwall has reached its relaxed position (i.e. the tube body is relaxed), the remaining caulking composition which is exposed to air is allowed to harden and thus form a proper seal. The remaining composition within the cartridge chamber is sealed against the atmosphere.

After manufacture, i.e. during shelf storage before initial use, the backwall 11 is sealed similarly to conventional prior art systems.

The caulking tube system with a spacing $\Delta D>0.0$ mm may at first appear illogical because the compositions contained in such tubes cure upon contact with the air and any such opening rather goes against common sense. However, the inventor has been able to ascertain that, after actuation, a sealing ring of dried composition forms between the flange 12 and the inner wall surface of the tube 8. As the piston 4 pushes the backwall 11 forward during the next dispensing operation, that temporary seal is broken and the slide seal between the flange 12 and the inner wall surface of the tube 8 is effected by soft composition. When the pressure on the piston 4 by the piston stem 3 is relaxed immediately after dispensing, the contracting tube 8 is able to push the backwall 11 back, instead of causing undesireable afterflow.

Figure 4:
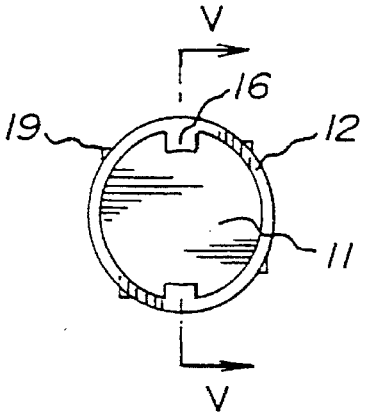
FIG. 4 is rear elevational view of a backwall of a caulking cartridge of a second embodiment.
Figure 5:
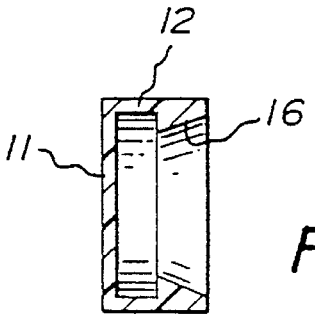
FIG. 5 is a section thereof taken along the line V—V in FIG. 4.
Figure 6:
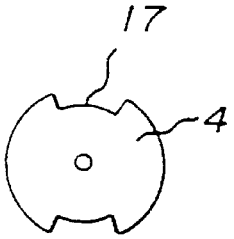
FIG. 6 is a front elevational view of a piston corresponding to the embodiment of FIGS. 4 and 5.
Figure 7:
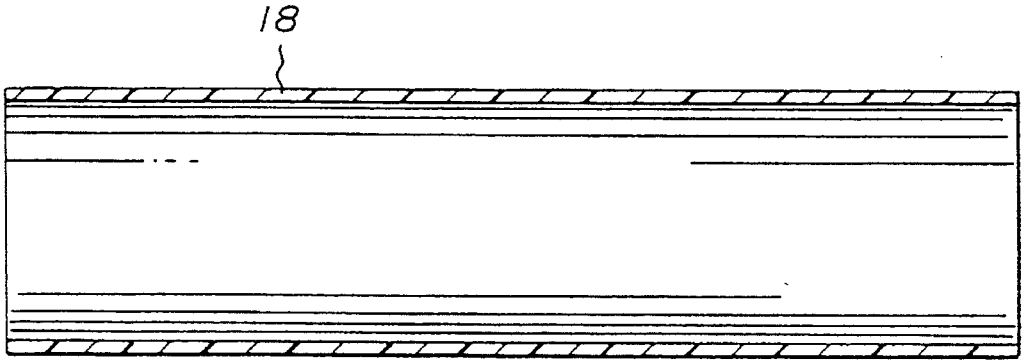
FIG. 7 is a longitudinal section of a rigid sleeve according to a third embodiment of the invention.

With reference to FIG. 4, a second embodiment, which may be combined with the first embodiment, is defined with an active pull-back feature. The flange 12 is provided with two mutually opposite latches 16. As the piston 4 is pushed into the opening defined by the flange 12, it engages behind the latches 16. When the backwall 11 is thus engaged, it is possible to actively retract the backwall 11 by pulling back on the stem 3. In a preferred embodiment (FIG. 6), the piston plunger 4 may be provided with cutouts 17, which allow selective engagement of the piston 4 with the latches 16.

Referring again to FIG. 4, the spacing between the inner tube wall surface and the flange 12 may be defined by ridges 19 integrally formed on the circumference on the backwall 11, i.e. on the flange 12.

In a third embodiment, the radial expansion of the tube 8 is prevented altogether in that a non-elastic sleeve 18 is slipped over the tube 8. The sleeve 18 may be formed of hard PVC, fiber reinforced plastic, metal, or similar material. The inner diameter of the sleeve 18 is chosen such that it corresponds with the outer diameter of the tube 8. Furthermore, the sleeve 18 is made as thin as possible, so that it still fits into the trough 2 of the caulking gun.

Figure 8:
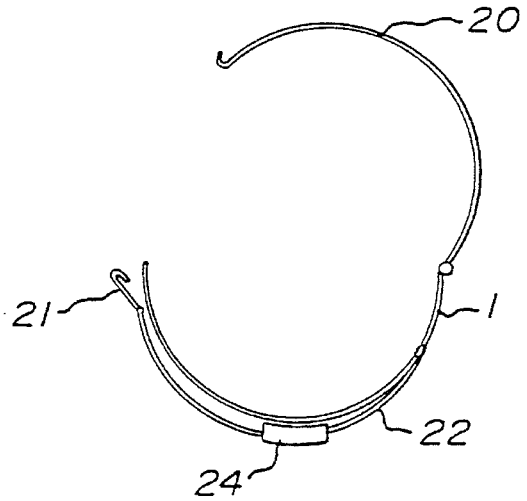
FIG. 8 is a diagrammatic front view section of a trough of a caulking gun.

With reference to FIG. 8, the rigid sleeve may be replaced with a top lid 20 which is articulated at an edge of the trough 1 of the caulking gun body. As the lid 20 is closed and latched into a latch hook 21, a rigid sleeve is formed for the caulking tube.

Figure 9:
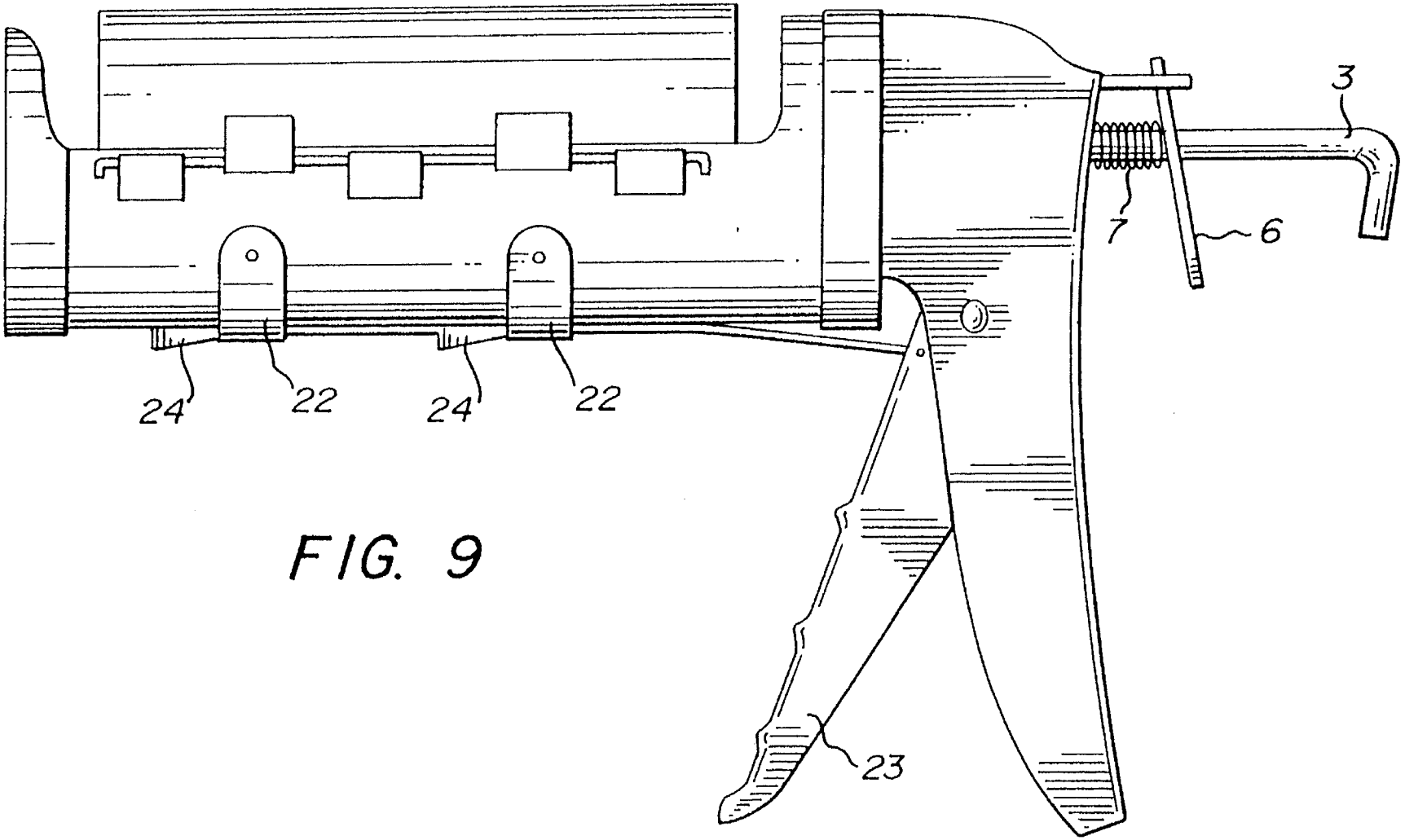
FIG. 9 is a side elevational view of a caulking gun with a squeeze mechanism.

Finally, in a fourth embodiment, the tube 8 is squeezed in addition to dispensing by forwarding the backwall 11. When dispensing is no longer desired, the squeeze on the tube 8 is relaxed. Accordingly, in a preferred structural embodiment of the invention, the caulking gun is provided with a clamp device which squeezes the tube simultaneously to forwarding the backwall 11. As illustrated in FIGS. 8 and 9, the lid 20 is braced with two strips 22 connected between the latch 21 and, with the opposite ends thereof, the trough body 1. As the trigger handle 23 is pulled for advancing the piston 4, wedges 24 are pulled below the strips 22. This causes the strips 22 to clamp down the lid 20 and thus to actively compress the caulking tube 8. The lid 20 is preferably formed with a slightly larger diameter than the trough. This leads to a slightly elliptical cross section of the space which is occupied by the caulking cartridge.

While we have herein referred to "caulking guns" and "caulking compositions", it should be understood that the terms are to be understood as commonly used in the art, namely any such dispenser with piston actuated volume reduction in tubular containers and with compositions of any type which are subject to the afore-mentioned afterflow problem.

I claim:

1. An improved caulking cartridge, of the type having a substantially tubular body, a forward dispensing opening at a forward end of the tubular body, a backwall movably disposed within the tubular body, the tubular body having a wall with an inner wall surface defining an inner diameter of the tubular body, and the tubular body defining a chamber therein bounded by the inner wall surface, the forward end and the backwall, the improvement which comprises:

the backwall having a diameter less than the inner diameter of the tubular body and defining a substantially contact-free spacing distance between the inner wall surface and a periphery of the backwall such that the backwall moves backwardly away from the forward end of the tubular body when a pressure inside the chamber is greater than a pressure outside the chamber.

2. The cartridge according to claim 1, wherein said spacing distance is at least 0.2 mm.

3. The cartridge according to claim 1, wherein said spacing distance is at least 1.0 mm.

4. The cartridge according to claim 1, which further comprises spacer ridges formed on a circumference of said backwall, said spacer ridges being in contact with said inner wall surface of said tubular body and defining said spacing distance.

5. An improved caulking cartridge, of the type having a substantially tubular body, a forward dispensing opening at a forward end of the tubular body, a backwall movably disposed within the tubular body, said backwall being adapted to be moved forward towards the forward end upon being forced by a caulking gun plunger, the tubular body having a wall with an inner wall surface defining an inner diameter of the tubular body, and the tubular body defining a chamber therein for receiving caulking composition bounded by the inner wall surface, the forward end and the backwall, the improvement which comprises:

the backwall being a pressure-responsive, rigid backwall having a diameter chosen such that the backwall is allowed to move backwardly away from the forward end of the tubular body by a pressure inside the chamber when the backwall is not being pushed forward by the caulking gun plunger and the pressure inside the chamber is greater than a pressure outside the chamber.

6. An improved caulking cartridge, of the type having a substantially tubular body, a forward dispensing opening at a forward end of the tubular body, a backwall movably disposed within the tubular body, said backwall being adapted to be moved forward towards the forward end upon being forced by a caulking gun plunger, the tubular body having a wall with an inner wall surface defining an inner diameter of the tubular body, and the tubular body defining a chamber therein for receiving caulking composition bounded by the inner wall surface, the forward end and the backwall, the improvement which comprises:

the backwall being a pressure-responsive, rigid backwall having a diameter chosen such that the caulking composition is allowed to flow in between the backwall and the inner wall surface as the backwall is pushed forward towards the forward end of the tubular body, and the backwall is allowed to move backwardly away from the forward end of the tubular body by a pressure inside the chamber when the backwall is not being pushed forward by the caulking gun plunger and the pressure inside the chamber is greater than a pressure outside the chamber.

* * * * *

UNITED STATES PATENT AND TRADEMARK OFFICE

CERTIFICATE OF CORRECTION

PATENT NO. : 5,582,331
DATED : December 10, 1996
INVENTOR(S) : Arthur Van Moerkerken It is certified that error appears in the above-indentified patent and that said Letters Patent is hereby corrected as shown below:

Item (30) Foreign Application Priority Data should read:

September 13, 1994 (NE) Netherlands ..... 9401492

Signed and Sealed this

Eighth Day of April, 1997

Bruce Lehman

*Attest:*

BRUCE LEHMAN

*Attesting Officer*

*Commissioner of Patents and Trademarks*